US010421639B2

(12) United States Patent
Kondo

(10) Patent No.: US 10,421,639 B2
(45) Date of Patent: Sep. 24, 2019

(54) ELEVATOR SYSTEM AND ELEVATOR INSPECTION METHOD FOR DRIVING A HOISTING MACHINE WHILE KEEPING AN EMERGENCY STOPPER OPERATIONAL

(71) Applicant: Mitsubishi Electric Corporation, Chiyoda-ku (JP)

(72) Inventor: Rikio Kondo, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 472 days.

(21) Appl. No.: 15/306,968

(22) PCT Filed: Nov. 20, 2014

(86) PCT No.: PCT/JP2014/080772
§ 371 (c)(1),
(2) Date: Oct. 26, 2016

(87) PCT Pub. No.: WO2015/166602
PCT Pub. Date: Nov. 5, 2015

(65) Prior Publication Data

US 2017/0050820 A1 Feb. 23, 2017

(30) Foreign Application Priority Data

Apr. 30, 2014 (JP) ..... 2014-093778

(51) Int. Cl.
*B66B 1/34* (2006.01)
*B66B 5/00* (2006.01)
(Continued)

(52) U.S. Cl.
CPC ..... *B66B 5/0093* (2013.01); *B66B 1/3492* (2013.01); *B66B 5/0025* (2013.01);
(Continued)

(58) Field of Classification Search
CPC ... B66B 5/0093; B66B 1/3492; B66B 5/0025; B66B 5/0031; B66B 5/02; B66B 9/00; B66B 5/12
(Continued)

(56) References Cited

U.S. PATENT DOCUMENTS 4,002,973 A * 1/1977 Wiesendanger ..... B66B 5/0087 187/391
4,538,706 A * 9/1985 Koppensteiner ..... B66B 5/22 187/376
(Continued)

FOREIGN PATENT DOCUMENTS

JP 2005-247433 A 9/2005
JP 2007-8669 A 1/2007
(Continued)

OTHER PUBLICATIONS

International Search Report dated Feb. 17, 2015 in PCT/JP2014/080772, filed Nov. 20, 2014.

*Primary Examiner* — Anthony J Salata
(74) *Attorney, Agent, or Firm* — Oblon, McClelland, Maier & Neustadt, L.L.P.

(57) ABSTRACT

In an elevator system, whether an emergency stopper thereof operates normally can be confirmed by letting a driving sheave run idle even in a case where the driving force of a hoisting machine is not large enough, the elevator system includes a main rope to suspend an elevator car and a counterweight, the emergency stopper to prevent the elevator car from dropping, the driving sheave, with the main rope wound around, to drive the main rope by a frictional force therebetween, the hoisting machine to rotate the driving sheave, and an elevator controller to drive the hoisting machine, wherein the elevator controller drives the hoisting machine, with the emergency stopper kept in operation, to
(Continued)

let the driving sheave run idle by exciting vertical natural period vibration of the counterweight.

12 Claims, 10 Drawing Sheets

(51) Int. Cl.
*B66B 5/02* (2006.01)
*B66B 9/00* (2006.01)
*B66B 5/12* (2006.01)

(52) U.S. Cl.
CPC ..... *B66B 5/0031* (2013.01); *B66B 5/02* (2013.01); *B66B 9/00* (2013.01); *B66B 5/12* (2013.01)

(58) Field of Classification Search
USPC ..... 187/247, 256, 261, 288, 351, 356, 364, 187/365, 366, 370, 371, 373, 377, 391, 187/393
See application file for complete search history.

(56) References Cited

U.S. PATENT DOCUMENTS 5,233,139 A * 8/1993 Hofmann ..... B66B 5/0087 187/251
6,516,921 B1 * 2/2003 Wang ..... B66B 5/027 187/263
7,905,330 B2 * 3/2011 Jahkonen ..... B66B 5/0018 187/247
7,942,246 B2 * 5/2011 Saarikoski ..... B66B 1/34 187/290
8,261,886 B2 * 9/2012 Kigawa ..... B66B 5/00 187/288
8,463,462 B2 * 6/2013 Cahill ..... B60T 17/221 187/248
8,746,413 B2 * 6/2014 Schroeder-Brumloop ..... B66B 5/0093 187/288
2010/0018810 A1 * 1/2010 Yumura ..... B66B 5/02 187/258
2010/0154527 A1 * 6/2010 Illan ..... B66B 5/0093 73/121
2011/0266097 A1 * 11/2011 Valjus ..... B66B 7/062 187/254
2019/0077632 A1 * 3/2019 Kondo ..... B66B 5/0025

FOREIGN PATENT DOCUMENTS

JP 2009-155075 A 7/2009
JP 2011-32075 A 2/2011
WO WO 03/074407 A1 9/2003

* cited by examiner

ELEVATOR SYSTEM AND ELEVATOR INSPECTION METHOD FOR DRIVING A HOISTING MACHINE WHILE KEEPING AN EMERGENCY STOPPER OPERATIONAL

TECHNICAL FIELD

The present invention relates to an elevator system equipped with an emergency stopper and an elevator inspection method.

BACKGROUND ART

Operation inspection of an emergency stopper equipped to an elevator system has been conducted to confirm that the emergency stopper operates normally by checking whether or not the driving sheave runs idle while the elevator car remains stationary when the elevator car is driven in the descending direction at a low speed under the condition that the rope holding mechanism kept in operation. (For example, refer to Patent Document 1)

PRIOR ART REFERENCE

Patent Document

Patent Document 1: Japanese Patent Application Publication No. 2005-247433

SUMMARY OF INVENTION

Problem(s) to be Solved by the Invention

In a conventional elevator system, there has been a problem that, if the driving force of the hoisting machine is not large enough, whether or not the emergency stopper operates normally cannot be confirmed because the driving sheave cannot be let run idle in such cases when the frictional force of the main rope surface is large, when the frictional force of the driving sheave groove is large, or when the weight of the elevator car is heavy.

The purpose of the present invention is to solve the problem described above, and to provide an elevator system whose emergency stopper can be confirmed on whether or not it is operating normally by letting the driving sheave run idle even in a case where the driving force of the hoisting machine is not large enough.

Means to Solve Problem(s)

The elevator system according to the present invention includes a main rope to suspend an elevator car and a counterweight, an emergency stopper to prevent the elevator car from dropping, a driving sheave, with the main rope wound around, to drive the main rope by a frictional force therebetween, a hoisting machine to rotate the driving sheave, and an elevator controller to drive the hoisting machine, wherein the elevator controller drives the hoisting machine, with the emergency stopper kept in operation, to let the driving sheave run idle by exciting vertical natural vibration of the counterweight.

Effects of the Invention

According to the present invention, the elevator system includes a main rope to suspend an elevator car and a counterweight, an emergency stopper to prevent the elevator car from dropping, a driving sheave, with the main rope wound around, to drive the main, rope by a frictional force therebetween, a hoisting machine to rotate the driving, sheave, and an elevator controller to drive the hoisting machine, and the elevator controller drives the hoisting machine, with the emergency stopper kept in operation, to let the driving sheave run idle by exciting vertical natural vibration of the counterweight. Therefore, the emergency stopper can be confirmed on whether it operates normally even in a case where the driving force of the hoisting machine is not large enough.

EMBODIMENTS TO CARRY OUT THE INVENTION

Embodiment 1

Figure 1:
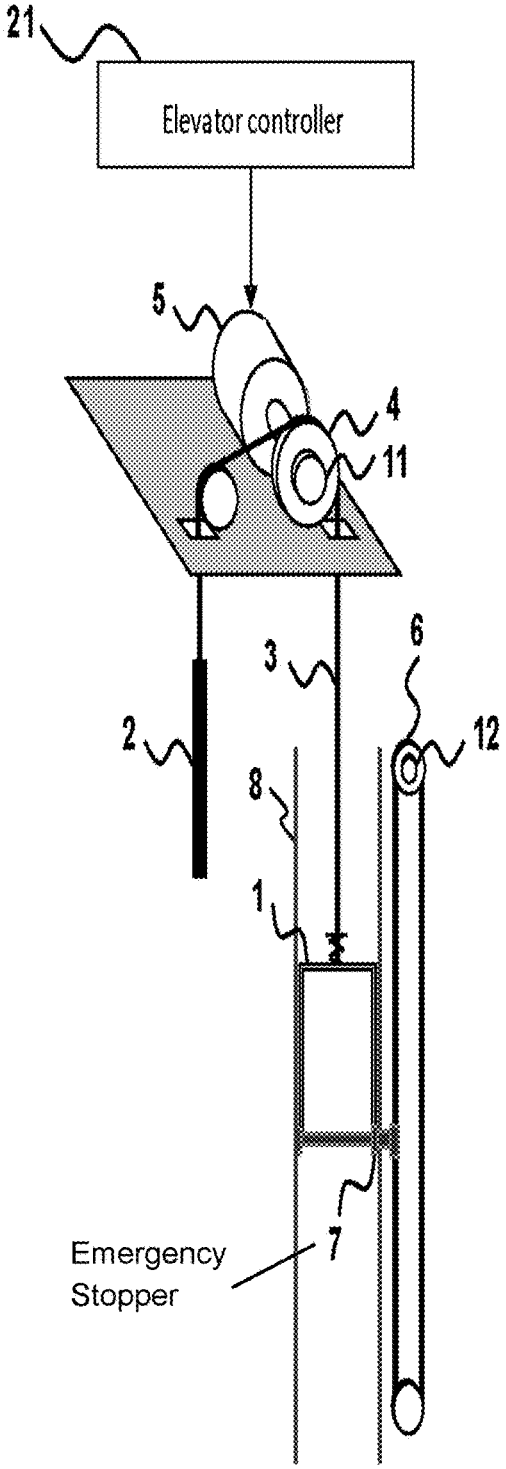
FIG. 1 is a configuration diagram of an elevator system according to Embodiment 1 of the present invention.

FIG. 1 is a configuration diagram of an elevator system according to Embodiment 1 of the present invention. A main rope 3 which suspends an elevator car 1 and a counterweight 2 is wound around a driving sheave 4. An elevator controller 21 controls a hoisting machine 5 to rotate the driving sheave 4 which synchronizes with the hoisting machine 5, and the elevator car 1 and the counterweight 2, both connected with the main rope 3, travel vertically inside the hoist way. A speed governor 6 activates an emergency stopper 7 when it detects that the speed of the elevator car 1, with which the speed governor 6 travels together, has exceeded a specified speed. The emergency stopper 7 prevents the elevator car 1 from dropping by holding the rail 8 in response to a signal from the speed governor 6. A hoisting machine rotation detector 11 detects the rotation angle of the hoisting machine 5. An elevator car position detector 12, which detects the rotation angle of the speed governor 6, can measure the moving distance of the elevator car 1 which travels with the speed governor 6.

Figure 2:
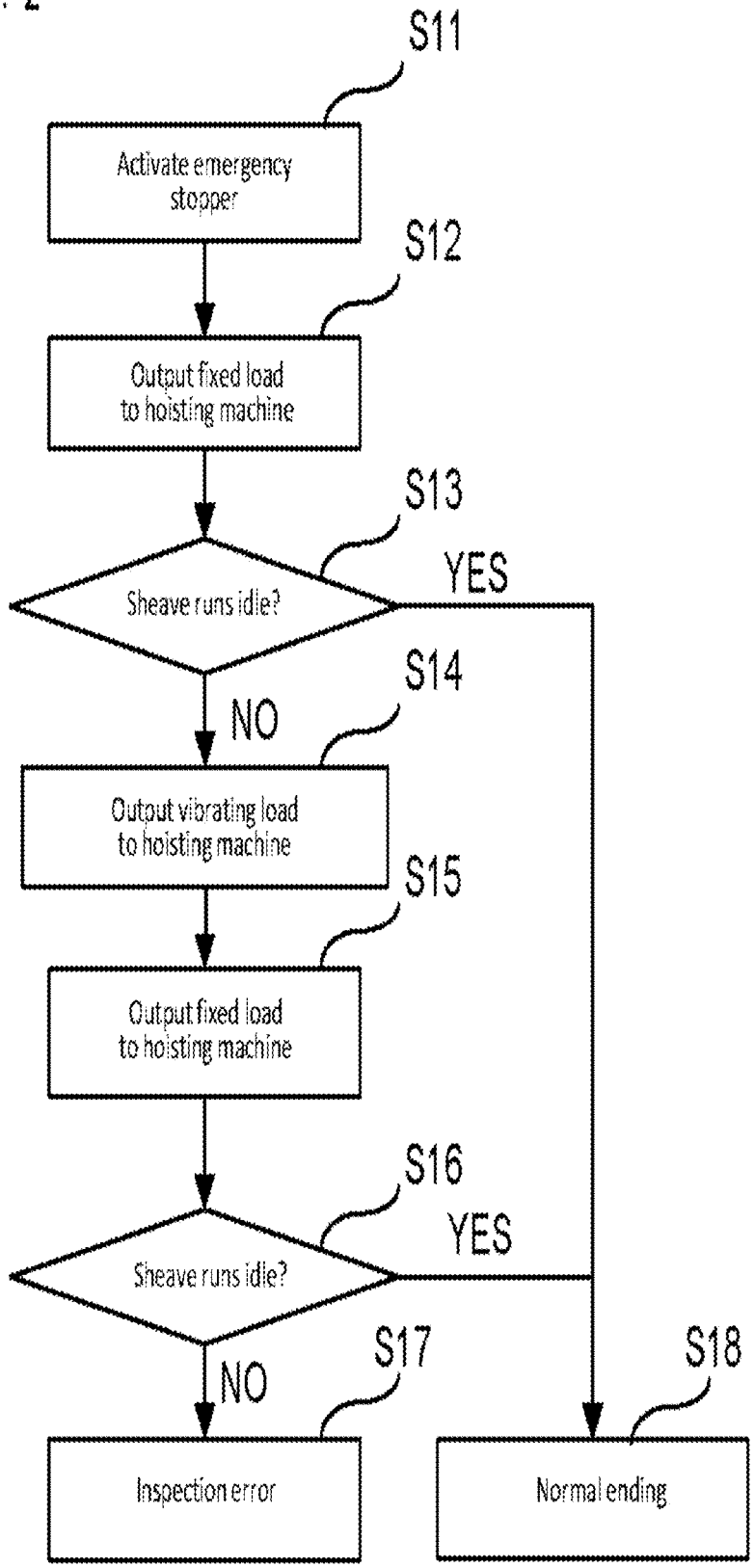
FIG. 2 is a diagram which shows an inspection procedure of an emergency stopper according to Embodiment 1 of the present invention.

Next, an inspection procedure of the emergency stopper 7 of the elevator system in Embodiment 1 of the present invention will be explained. FIG. 2 is a diagram which shows the inspection procedure of the emergency stopper 7. In Step S11, the emergency stopper 7 is made ready to operate, for example, by unrotatably holding the speed governor 6 stationarily. As a result of this, the emergency stopper 7 becomes ready to operate when the elevator car 1 drops. In Step S12, the hoisting machine 5 is driven at a fixed load output in the direction in which the elevator car 1 descends. As a result, in Step 13, it is checked whether or not the driving sheave 4 runs idle, in other words, whether or not the main rope 3 is slipping on the driving sheave 4. If the driving sheave 4 runs idle, this means that the emergency stopper 7 prevents the elevator car 1 from dropping, and it can be determined that the soundness of the holding function of the emergency stopper 7 is ensured.

In Step S13, on the other hand, if the main rope 3 is not slipping on the driving sheave 4, the emergency stopper 7 is inspected by following the procedure from Step 14 through Step S16. In Step S14, the hoisting machine 5 is driven so that the counterweight 2 will vibrate vertically at a fixed period. The operation in Step S14 will be explained in detail later. After that, in Step S15, the hoisting machine 5 is driven at a fixed load output in the direction in which the elevator car 1 descends. Then, in Step S16, it is checked whether or not the driving sheave 4 runs idle. If the driving sheave 4 runs idle, the holding function is determined to be normal. If the driving sheave 4 does not run idle, it is determined to be an "inspection error", concluding that the soundness of the bolding function of the emergency stopper 7 cannot be confirmed.

Next, the detail of operation in Step S14 shown in FIG. 2 will be explained. Shown below are the motion equations which indicate the motions of an elevator in Embodiment 1 of the present invention.

[Equation 1]

$$F=T_2-T_1 \tag{1}$$

$$Mg=F_s+T_1 \tag{2}$$

$$mg=T_2 \tag{3}$$

Here, F is the driving force of the hoisting machine 5, M is the mass of the elevator car 1, m is the mass of the counterweight 2 and g is the gravity acceleration. Both T1 and T2 are the tensions applied to the main rope 3. The tension on the side of the elevator car 1 across the driving sheave 4 is T1, and the tension on the side of the counterweight 2 across the driving sheave 4 is T2. Fs is the holding force of the emergency stopper 7 to hold the rail 8.

In Step S14 of FIG. 2, the hoisting machine 5 is driven in such a manner that the main rope 3 will expand and contract to excite vertical natural period vibration of the counterweight 2. To be more concrete, the vibration can be excited by driving the hoisting machine 5 with an arbitrary driving force amplitude f and the driving force F having a specified period ω, both of which appear in the formula below.

[Equation 2]

$$F=f\sin(\omega t) \tag{4}$$

Here, when letting Ω be the vertical natural vibration period of the counterweight 2, Ω is obtained by the following formula.

[Equation 3]

$$\Omega=2\pi\sqrt{\frac{k}{m}} \tag{5}$$

Here, k is the spring constant of the main rope 3 derived from the elasticity between the driving sheave 4 and the counterweight 2. Generally, because the spring constant k of the main rope 3 derived from its elasticity is determined by the characteristics and the length of the main rope 3, the natural vibration period Ω changes in accordance with the lifting stroke and the position of the elevator car 1. Therefore, a large amplitude vibration can be excited by bringing the vibration period ω caused by driving the hoisting machine 5 closer to the natural vibration period Ω, changing the natural vibration period Ω by moving the position of the elevator car 1. In some cases, a damping spring or the like may be disposed in series between the driving sheave 4 and the counterweight 2. In such cases, the spring constant k derived from the elasticity of the main rope 3 between the driving sheave 4 and the counterweight 2 is determined, considering the spring constant component of the damping spring.

When vibrated by driving the hoisting machine 5 as described above, the tension $T_2$ of the main rope 3 on the side of the counterweight 2 is indicated as below.

[Equation 4]

$$T_2=m(g+\alpha\sin(\omega t+\delta)) \tag{6}$$

Here, δ is the phase shift amount of the vertical vibration from the input signal by which the elevator controller 21 controls the hoisting machine 5, and α is the vibration amplitude of the vibration period ω.

In the control of the emergency stopper inspection mode, the counterweight 2 is vibrated at the vibration period ω which is close enough to the natural vibration period Ω to excite the vertical vibration. Then, a driving power is applied to the hoisting machine 5 in the direction to lift the counterweight 2, namely in the direction to lower the elevator car 1. Here, the tension $T_1$ of the main rope 3 on the side of the elevator car 1 is obtained by the formula below.

[Equation 5]

$$T_3=m\{g+\alpha_0\exp(-\beta(t-t_0)\sin(\omega t+\delta)\}+F_0 \tag{7}$$

Now, $F_0$ is the driving force outputted by the hoisting machine 5, and supposed to be a constant value here. Note that α in Formula (6) is replaced by α0 exp(−β(t−t0)) in Formula (7) because the vibration amplitude damps down gradually. Here, β is the damping coefficient, t is time, and t0 is the time when the excitation of the vertical vibration is stopped.

Figure 3:
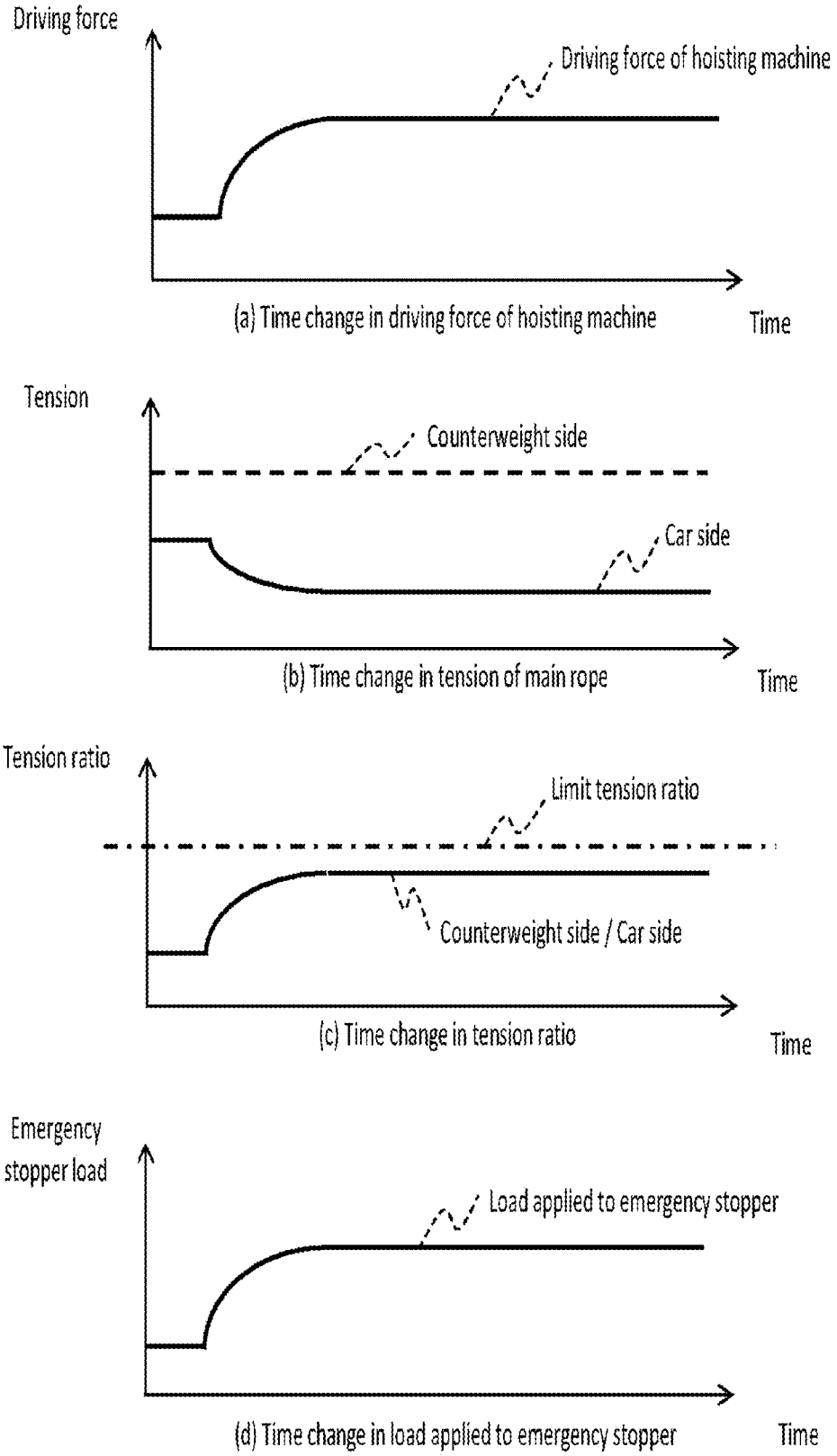
FIG. 3 is a diagram which shows the change in state quantity of a conventional elevator system under inspection of its emergency stopper.
Figure 4:
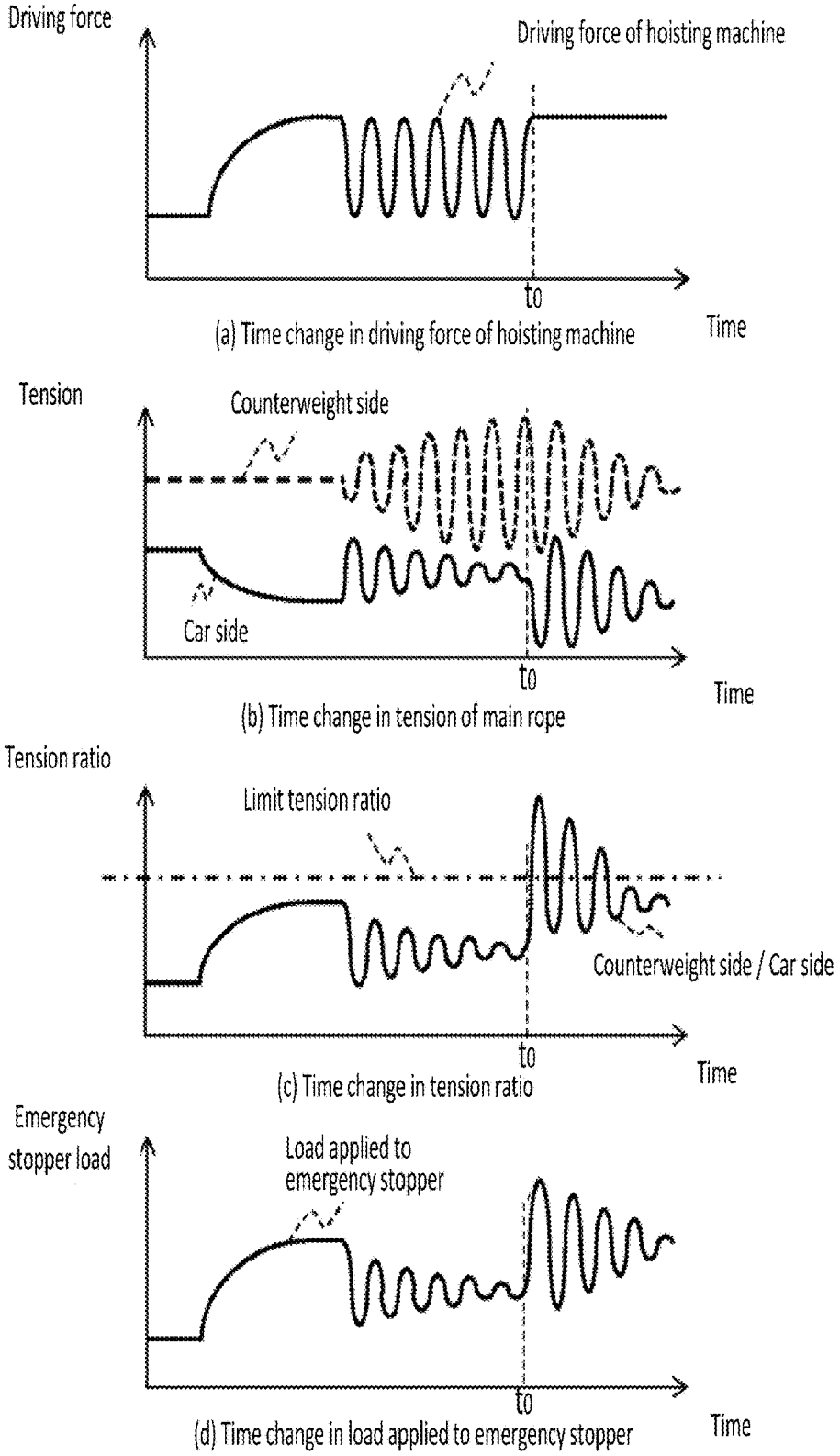
FIG. 4 is a diagram which shows the change in state quantity of the elevator system according to Embodiment of the present invention under inspection of its emergency stopper.

Next, the change in the state quantity of the elevator system in Embodiment 1 of the present invention will be explained. FIG. 3 includes graphs which show the state changes of a conventional elevator system under inspection of the emergency stopper 7. FIG. 4 is a diagram which shows the state changes of the elevator system in Embodiment 1 of the present invention under inspection of the emergency stopper 7. Shown in each graph are: (a) time change in the driving force of the hoisting machine 5; (b) time change in the tension of the main rope 3; (c) time change in the ratio of the tension of the main rope 3 on the side of the counterweight 2 across the driving sheave 4 to the tension of the main rope 3 on the side of the elevator car 1 across the driving sheave 4; and (d) time change in the load applied to the emergency stopper 7.

In the conventional elevator system under inspection of the emergency stopper 7 shown in FIG. 3, the hoisting machine 5 is made to generate a fixed driving force in the direction in which the elevator car 1 descends with the emergency stopper 7 kept in operation. At the moment, the tension of the main rope 3 on the side of the counterweight 2 across the driving sheave 4 does not change because the weight of the counterweight 2 does not change, while the tension of the main rope 3 on the side of the elevator car 1 across the driving sheave 4 is lowered. Consequently, the ratio of the tension of the main rope 3 on the side of the counterweight 2 across the driving sheave 4 to the tension of the main rope 3 on the side of the elevator car 1 across the driving sheave 4 becomes larger and the load to be carried by the main rope 3 is lowered. As the result, the load weight to be held by the emergency stopper 7 increases. Here, when the tension ratio of the main rope 3 exceeds the limit tension ratio, the driving sheave 4 rims idle. The limit tension ratio is determined by various elements such as the shape of the driving sheave 4, the contact amount of the driving sheave 4 and the main rope 3, the materials of the driving sheave 4 and the main rope 3, and the temperature environment. Therefore, if the elevator system whose emergency stopper 7 is to be inspected has a high limit tension ratio, for example, the driving sheave 4 will not run idle and, as a result, the emergency stopper 7 cannot be inspected.

On the other hand, in the inspection of the emergency stopper 7 of the elevator system in Embodiment 1 of the present invention shown in FIG. 4, the hoisting machine 5 is made to generate a driving force which includes periodic variation, with the emergency stopper 7 kept in operation. In this explanation, in order to verify the effects of the present invention, the conditions other than the operation conducted to inspect the emergency stopper 7 are supposed to be the same as those for the conventional elevator system shown in FIG. 3, including the limit tension ratios under the maximum driving forces to be generated by the hoisting machines 5. In the inspection, shown in FIG. 4, of the emergency stopper 7 in Embodiment 1 of the present invention, the vertical variation in the tension of the main rope 3 is caused by exciting the vertical vibration on the side of the counterweight 2. In FIG. 4, taking notice of time change (b) in tension of the main rope, the tension vibration remains even after the time $t_0$ when the periodic variation to the hoisting machine 5 is stopped. Therefore, if the hoisting machine 5 is made to keep generating a fixed driving force in the clirection in which the elevator car 1 descends, the tension of the main rope 3 on the side of the elevator car 1 across the driving sheave 4 and the tension of the main rope 3 on the side of the counterweight 2 across the driving sheave 4 come to vibrate in the same phase. As the result, at the timing when both of the tensions to the main rope 3 are lowered, the ratio of the two tensions applied to the main rope 3 becomes higher, and the tension ratio exceeds the limit tension ratio, so that the driving sheave 4 runs idle. Therefore, even in a case where the emergency stopper 7 of the conventional elevator system cannot be inspected because the driving sheave 4 cannot be let run idle, now the driving sheave 4 can be let run idle to conduct inspection of the emergency stopper 7. While the driving sheave 4 is running idle, the tension of the main rope 3 on the side of the elevator ear 1 across the driving sheave 4 becomes the lowest and the load applied to the emergency stopper 7 becomes the maximum. Therefore, the inspection can be conducted with the higher load being applied to the emergency stopper 7 than in the conventional inspection.

In the example shown in FIG. 4, it is explained that, after the time $t_0$ when the hoisting machine 5 is made to stop generating the periodic variation, the hoisting machine 5 is made to keep generating a fixed driving force in the direction in which the elevator car 1 descends. The larger the driving force of the hoisting machine 5 after the periodic variation is, the higher the ratio between the two tensions both applied to the main rope 3 is, which facilitates the driving sheave 4 to run idle. In this case, even in a system where the driving sheave 4 is still harder to let run idle, the inspection of the emergency stopper 7 can be conducted. Also, even in a case where the vertical vibration of the counterweight 2 is small, the driving sheave 4 can be let run idle.

The larger the periodic variation to the hoisting machine 5 is, the larger the vertical vibration of the counterweight 2 becomes. Therefore, the tension ratio may sometimes exceed the limit tension ratio only with the periodic variation applied to the hoisting machine 5. In this case, it is not necessary, after the time $t_0$ when the hoisting machine 5 is made to stop generating the periodic variation, to make the hoisting machine 5 keep generating a fixed driving force in the direction in which the elevator car 1 descends.

While, in the elevator system according to Embodiment 1 of the present invention, the hoisting machine 5 is made to generate a driving force which includes the periodic variation, any type of control command can be adopted as long as it can excite the vertical vibration of the counterweight 2, including periodic triangular wave, rectangular wave and pulse. The command to the hoisting machine 5 to generate the driving force may be realized by speed control or the like as well as by directly controlling the driving force.

Embodiment 2

An elevator system in Embodiment 2 detects the running idle of a driving sheave 4 automatically. For an example, in the inspection of an elevator system without a machine room, it is difficult to check the running idle of the driving sheave 4 by visual inspection, which makes the automatic detection of the running idle of the driving sheave 4 very effective.

Figure 5:
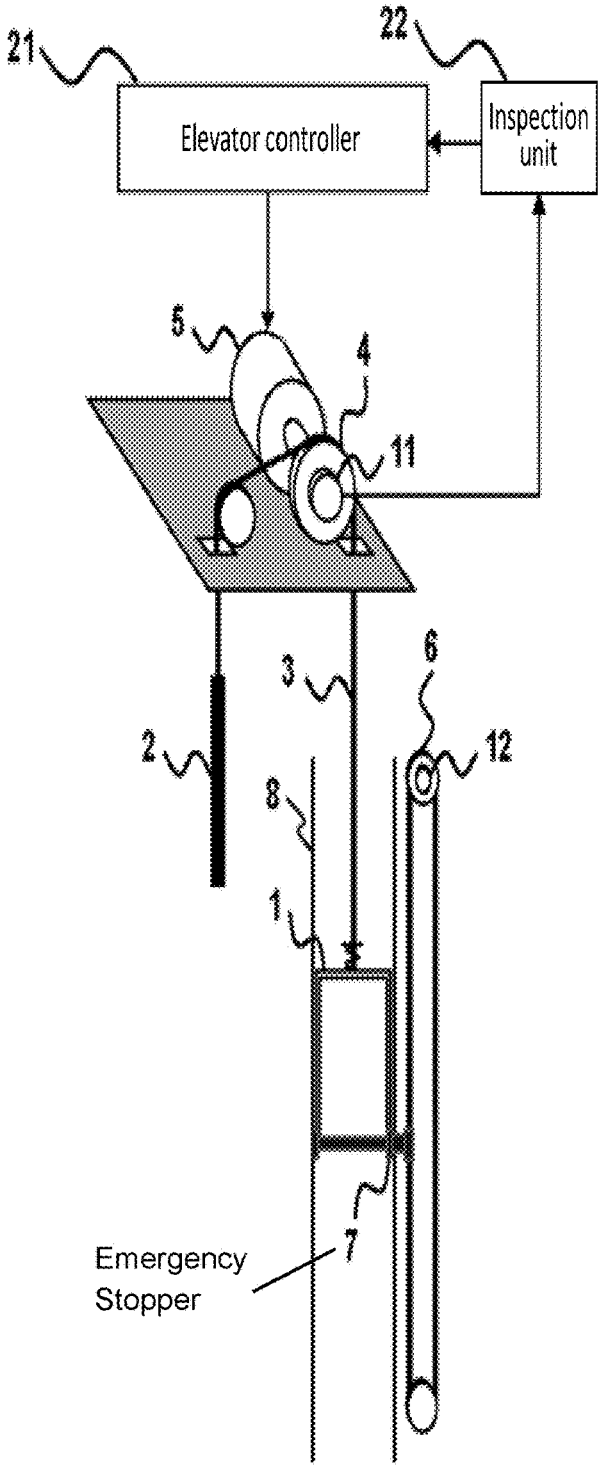
FIG. 5 is a configuration diagram of an elevator system according to Embodiment 2 of the present invention.

The configuration of the elevator system in Embodiment 2 of the present invention will be explained using FIG. 5. FIG. 5 shows an example of the elevator system according to Embodiment 2 of the present invention. When compared with FIG. 1 which shows the configuration of the elevator system according to Embodiment 1, the difference is that the output of a hoisting machine rotation detector 11 is inputted to an inspection unit 22 and the output of the inspection unit 22 is inputted to an elevator controller 21, with everything else being the same.

Figure 6:
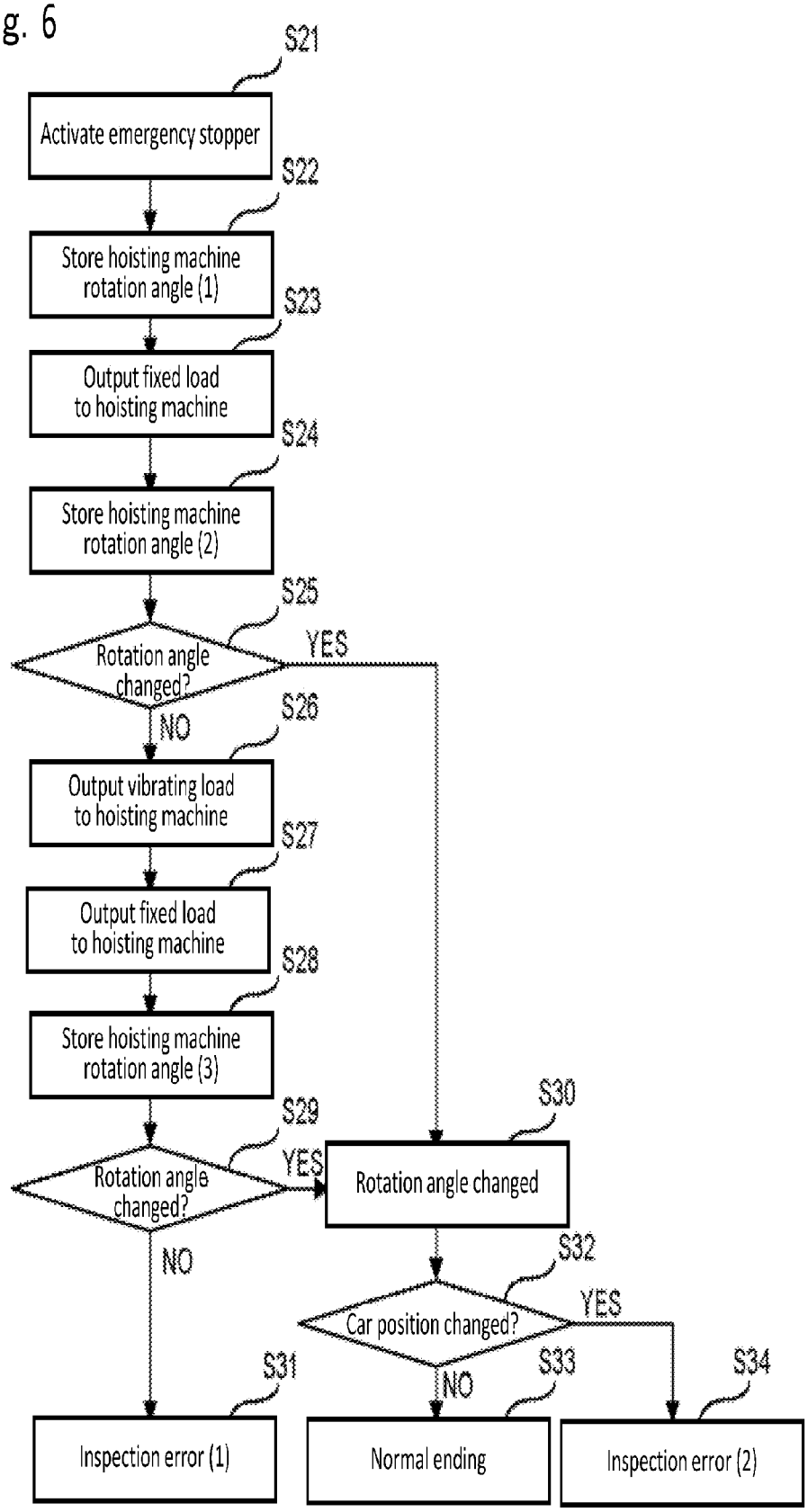
FIG. 6 is a diagram which shows the inspection procedure of an emergency stopper according to Embodiment 2 of the present invention.

Next, the inspection procedure of an emergency stopper 7 in the elevator system according to Embodiment 2 of the present invention will be explained. FIG. 6 is a diagram which shows the inspection procedure of the emergency stopper 7. In Step S21, the emergency stopper 7 is made ready for operation, for example, by unrotatably holding a speed governor 6 stationarily. Thereby, if an elevator car 1 drops, the speed governor 6 will bring the emergency stopper 7 in operation. Next, in Step 22, the rotation angle of the hoisting machine 5 outputted from the hoisting machine rotation detector 11 is stored in the inspection unit 22 as Rotation angle (1). In Step 23, the hoisting machine 5 is driven at a fixed load output in the direction in which the elevator ear 1 descends. After the driving force is brought down to zero, the rotation angle of the hoisting machine 5 outputted from the hoisting machine rotation detector 11 is stored in the inspection unit 22 as Rotation angle (2).

In Step 25, Rotation angle (1) and Rotation angle (2), both stored in the inspection unit 22, are compared. If Rotation angle (1) and Rotation angle (2) are different, the flow proceeds to Step S30, and the fact that the rotation angle has changed is reported to the inspector and so forth. If Rotation angle (1) and Rotation angle (2) are the same, in Step S26, the hoisting machine 5 is driven at a vibration load output so as for a counterweight 2 to vertically vibrate at a fixed period. Then, in Step S27, the hoisting machine 5 is driven at a fixed load output in the direction in which the elevator car 1 descends. Then, after the driving force is brought down to zero, in Step S28, the rotation angle of the hoisting machine 5 outputted from the hoisting machine rotation detector 11 is stored in the inspection unit 22 as Rotation angle (3).

In Step S29, Rotation angle (1) and Rotation angle (3), both stored in the inspection unit 22, are compared. If different, the flow proceeds to Step S30 and the fact that the rotation angle has changed is reported to the inspector and so forth. If Rotation angle (1) and Rotation angle (3) are the same, this means that the driving sheave 4 does not run idle. And it is determined to be "inspection error (1)", concluding that the soundness of the holding function of the emergency stopper 7 cannot be confirmed.

In Step S30, if the rotation angle has changed, this means that the driving sheave 4 runs idle. Therefore, in the next Step S32, whether or not there is a change between the position of the elevator car 1 in Step S21 and the position of the elevator car 1 in Step S32 is checked. If there is a change, in Step S34, it is determined to be "inspection error (2)", concluding that the soundness of the holding function of the emergency stopper 7 could not be confirmed. If there is no change, in Step S33, the result will be determined to be "normal". The reason to check, in Step S32, the positions of the elevator car 1 for determining whether normal or not is that whether the driving sheave 4 runs idle or not cannot be determined even if the driving sheave 4 rotates. This happens in such a case where the elevator car 1 moves because of insufficient capability of the emergency stopper 7 to hold the elevator car 1 stationarily.

Thus, in the elevator system according to Embodiment 2 of the present invention, even when confirmation of running idle of the driving sheave 4 is difficult due to a machine-room-less structure, whether or not the emergency stopper of an elevator system with a hoisting machine of not-large-enough driving force operates normally can be confirmed by letting the driving sheave run idle.

Embodiment 3

An elevator system according to Embodiment 3 of the present invention detects the running idle of a driving sheave 4 and the position of an elevator car 1 both automatically. Hence the checking whether or not the position of the elevator car 1 has moved is automated to dispense with determination of the workers, which improves the efficiency of the inspection work.

Figure 7:
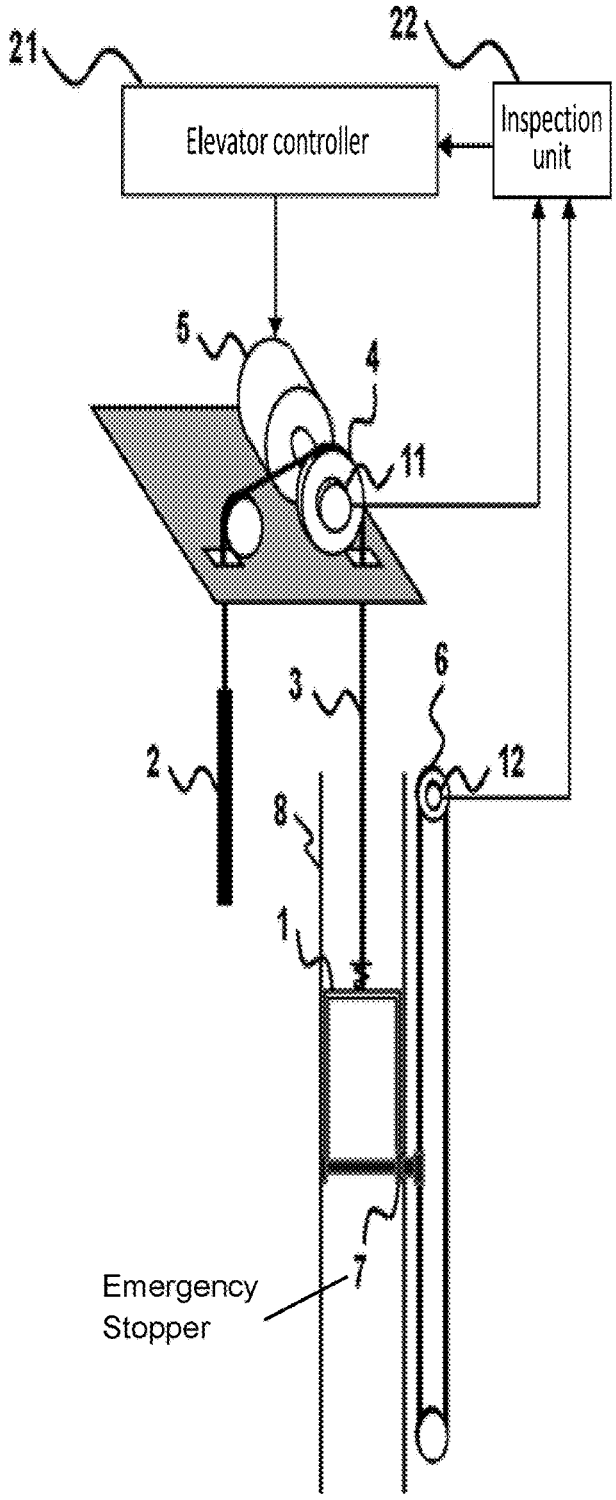
FIG. 7 is a configuration diagram of an elevator system according to Embodiment 3 of the present invention.

The configuration of the elevator system in Embodiment 3 will be explained using FIG. 7. FIG. 7 shows an example of the elevator system according to Embodiment 3 of the present invention. When compared with FIG. 5 which shows the configuration of an elevator system according to Embodiment 2, the difference is that the output of an elevator car position detector 12 is inputted to an inspection unit 22, with everything else being the same.

Figure 8:
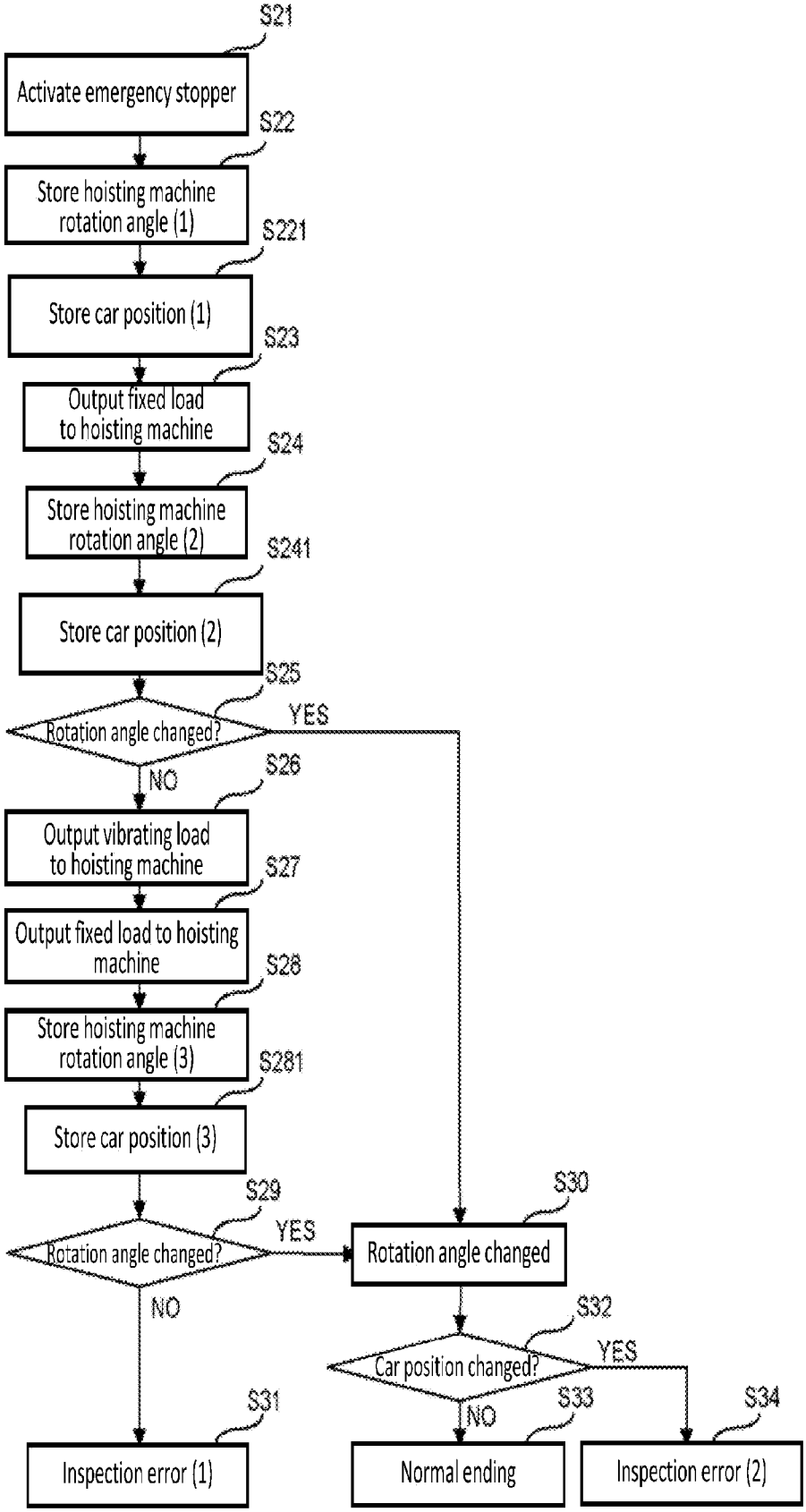
FIG. 8 is a diagram which shows the inspection procedure of an emergency stopper according to Embodiment 3 of the present invention.

Next, the inspection procedure of an emergency stopper 7 in the elevator system according to Embodiment 3 of the present invention will be explained. FIG. 8 is a diagram which shows the inspection procedure of the emergency stopper 7. When compared with FIG. 6 which shows the inspection procedure of the emergency stopper 7 of the elevator system according to Embodiment 2, the difference is that, after the hoisting machine rotation angle (1), the hoisting machine rotation angle (2) and the hoisting machine rotation angle (3) are stored in an elevator controller 21 in steps of S22, S24 and S28, respectively, then information items of the car position (1), the car position (2) and the car position (3), which are the outputs from the elevator car position detector 12 at their respective timings, are stored in the elevator controller 21 in steps of Step S221, S241 and S281, respectively, with everything else being the same. In Step S32, whether or not the car position has been changed is determined by either whether the stored data of the car position (1) and the car position (2) are the same, or whether the stored data of the car position (1) and the car position (3) are the same. Thus, whether or not the elevator car 1 has moved can be determined more accurately.

Embodiment 4

An elevator system according to Embodiment 4 of the present invention conducts the inspection automatically.

Figure 9:
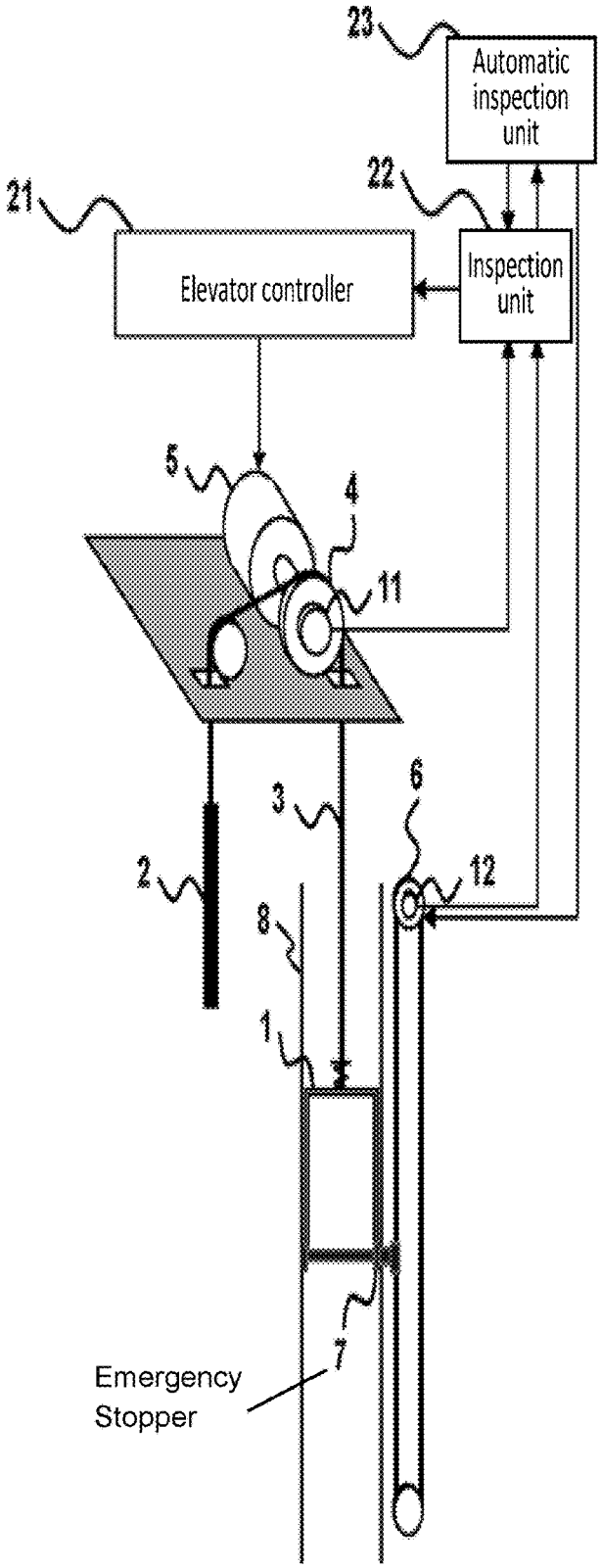
FIG. 9 is a configuration diagram of an elevator system according to Embodiment 4 of the present invention.

The configuration of the elevator system in Embodiment 4 will be explained using FIG. 9. FIG. 9 shows an example of the elevator system according to Embodiment 4 of the present invention. When compared with FIG. 7 which shows the configuration of an elevator system according to Embodiment 3, the difference is that this elevator includes an automatic inspection unit 23 which communicates with an inspection unit 22, the automatic inspection unit 23 unrotatably holding a speed governor 6 stationarily, with everything else being the same.

The automatic inspection unit 23 has an automatic inspection starting function and an automatic inspection ending function. The automatic inspection starting function is a function to start the automatic inspection by a specific trigger such as receiving an external instruction or referring to the internal clock for inspections at designated times and dates. The automatic inspection ending function is a function to make the inspection result accessible from outside by transmitting it outside, recording it in memory, etc. or displaying it on a display.

The automatic inspection unit 23 starts the automatic inspection by instructing the inspection unit 22 to start inspection, and ends the automatic inspection by receiving the inspection result from the inspection unit 22.

Figure 10:
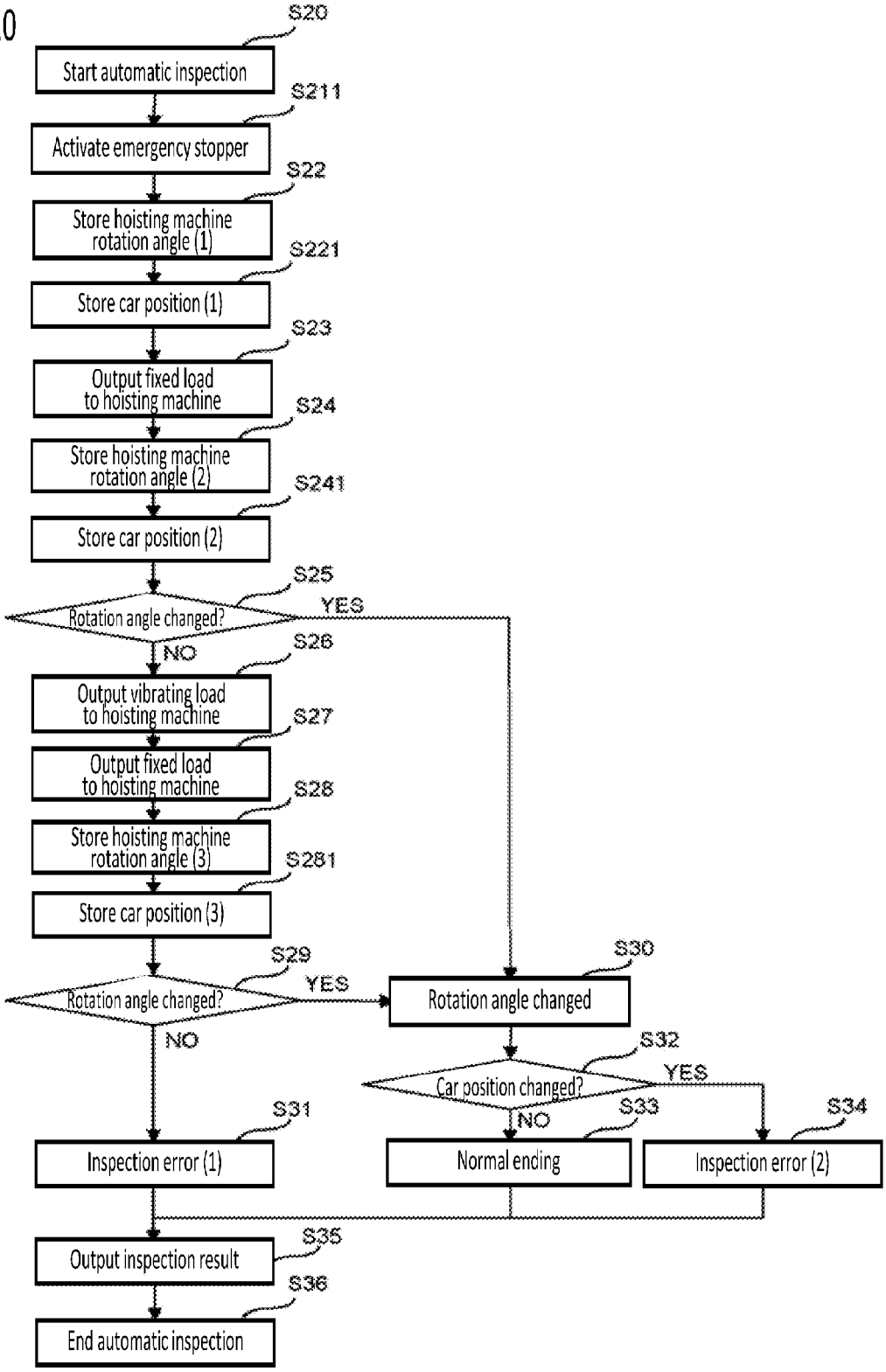
FIG. 10 is a diagram which shows an inspection procedure of an emergency stopper according to Embodiment 4 of the present invention.

Next, the inspection procedure of an emergency stopper 7 in the elevator system according to Embodiment 4 of the present invention will be explained. FIG. 10 is a diagram which shows the inspection procedure of the emergency stopper 7. In Step S20, the automatic inspection unit 23 starts the automatic inspection. In Step S211, the automatic inspection unit 23 instructs the speed governor 6 to unrotatably hold itself stationarily to make the emergency stopper 7 ready for operation. Step S22 through Step S34 are the same as in the inspection procedure of the emergency stopper 7 of the elevator system in Embodiment 3 shown in FIG. 8. In Step S35, the automatic inspection unit 23 receives, from the inspection unit 22, any one result out of three: "inspection error (1)" by Step S31, "normal ending"

by Step S33 and "inspection error (2)" by Step S34, and then, outputs the result by transmitting outside, recording in memory, etc. or clisplaying on the display. In Step S36, the automatic inspection unit 23 instructs the speed governor 6 to release itself to be rotatable so as for the emergency stopper 7 not to operate, to end the automatic inspection.

Thus, the elevator system according to Embodiment 4 of the present invention can realize remotely controlled automatic inspection and result acquisition, and automatic inspection scheduled by a timer, during a time slot when the elevator is rarely used, for example, at midnight or the like.

In explaining Embodiment 2 through Embodiment 4, the elevator controller 21, the inspection unit 22 and the automatic inspection unit 23 are described as independent from each other. However, all of these functions can be realized by one controller.

DESCRIPTION OF SYMBOLS

1 elevator car
2 counterweight
3 main rope
4 driving sheave
5 hoisting machine
7 emergency stopper
21 elevator controller

The invention claimed is:

1. An elevator system comprising:
a main rope to suspend an elevator car and a counterweight;
an emergency stopper to prevent the elevator car from dropping;
a driving sheave, with the main rope wound around, to drive the main rope by a frictional force therebetween;
a hoisting machine to rotate the driving sheave; and
an elevator controller to drive the hoisting machine,
wherein the elevator controller drives the hoisting machine, with the emergency stopper kept in operation, to let the driving sheave run idle by exciting vertical natural period vibration of the counterweight.

2. The elevator system according to claim 1, further comprising:
a hoisting machine rotation detector to detect a rotation angle of the hoisting machine; and
an inspection unit to confirm whether or not the emergency stopper operates normally on the basis of the rotation angle of the hoisting machine.

3. The elevator system according to claim 1, further comprising:
a hoisting machine rotation detector to detect a rotation angle of the hoisting machine;
an elevator car position detector to detect a position of the elevator car; and
an inspection unit to confirm whether or not the emergency stopper operates normally on the basis of the rotation angle of the hoisting machine and the position of the elevator car.

4. The elevator system according to claim 2, further comprising an automatic inspection unit to switch the emergency stopper between on and off states.

5. The elevator system according to claim 3, further comprising an automatic inspection unit to switch the emergency stopper between on and off states.

6. An elevator system comprising:
a main rope to suspend an elevator car and a counterweight;
an emergency stopper to prevent the elevator car from dropping;
a driving sheave, with the main rope wound around, to drive the main rope by a frictional force therebetween;
a hoisting machine to rotate the driving sheave; and
an elevator controller to drive the hoisting machine,
wherein the elevator controller drives the hoisting machine, with the emergency stopper kept in operation, to let the driving sheave run idle by exciting vertical natural period vibration of the counterweight and then driving the hoisting machine in a direction in which the elevator car descends.

7. The elevator system according to claim 6, further comprising:
a hoisting machine rotation detector to detect a rotation angle of the hoisting machine; and
an inspection unit to confirm whether or not the emergency stopper operates normally on the basis of the rotation angle of the hoisting machine.

8. The elevator system according to claim 6, further comprising:
a hoisting machine rotation detector to detect a rotation angle of the hoisting machine;
an elevator car position detector to detect a position of the elevator car; and
an inspection unit to confirm whether or not the emergency stopper operates normally on the basis of the rotation angle of the hoisting machine and the position of the elevator car.

9. The elevator system according to claim 7, further comprising an automatic inspection unit to switch the emergency stopper between on and off states.

10. The elevator system according to claim 8, further comprising an automatic inspection unit to switch the emergency stopper between on and off states.

11. An elevator inspection method to confirm whether an emergency stopper, for preventing an elevator car from dropping, operates normally by letting a driving sheave run idle, the driving sheave being wound around by a main rope suspending the elevator car and a counterweight, comprising:
making the emergency stopper in operation;
exciting vertical natural period vibration of the counterweight by driving a hoisting machine to rotate the driving sheave; and
confirming whether the emergency stopper operates normally on the basis of whether or not the driving sheave runs idle.

12. An elevator inspection method to confirm whether an emergency stopper, for preventing an elevator car from dropping, operates normally by letting a driving sheave run idle, the driving sheave being wound around by a main rope suspending the elevator car and a counterweight, comprising:
making the emergency stopper in operation;
exciting vertical natural period vibration of the counterweight by driving a hoisting machine to rotate the driving sheave, and then driving the hoisting machine in a direction in which the elevator car descends; and
confirming whether the emergency stopper operates normally on the basis of whether or not the driving sheave runs idle.

* * * * *